United States Patent [19]

Teleki

[11] Patent Number: 4,795,654

[45] Date of Patent: Jan. 3, 1989

[54] STRUCTURE FOR SHIELDING X-RAY AND GAMMA RADIATION

[75] Inventor: Péter Teleki, Dunaujváros, Hungary

[73] Assignee: INNOFINANCE Altalanos Innovacios Penzintezet, Budapest, Hungary

[21] Appl. No.: 914,406

[22] Filed: Oct. 2, 1986

[30] Foreign Application Priority Data

Oct. 22, 1985 [HU] Hungary ..... 4087/84
Apr. 30, 1986 [HU] Hungary ..... 1828/85

[51] Int. Cl.[4] ..... G21F 1/12

[52] U.S. Cl. ..... 428/635; 428/615; 428/644; 428/656; 250/515.1

[58] Field of Search ..... 250/515.1, 517.1, 518.1, 250/519.1; 428/607, 656, 643, 644, 671, 645, 635, 636, 686, 668, 660, 646, 651, 652

[56] References Cited

U.S. PATENT DOCUMENTS

| | | | |
|---|---|---|---|
| 315,008 | 4/1885 | Crooke | 428/607 |
| 2,580,366 | 12/1951 | Morrison | 250/517.1 |
| 2,928,948 | 3/1960 | Silversher | 250/108 |
| 2,993,264 | 7/1961 | Grenoble | 428/635 |
| 3,181,935 | 5/1965 | Coad | 428/607 |
| 3,367,755 | 2/1968 | Packer et al. | 428/671 |
| 3,515,874 | 6/1970 | Bens et al. | 250/86 |
| 3,978,803 | 9/1976 | Asano et al. | 428/647 |
| 4,041,872 | 8/1977 | McCown et al. | 250/515.1 |
| 4,081,689 | 3/1978 | Reiss | 250/515.1 |

FOREIGN PATENT DOCUMENTS

| | | | |
|---|---|---|---|
| 523755 | 11/1953 | Belgium . | |
| 160327 | 11/1985 | European Pat. Off. | 250/515.1 |
| 395611 | 7/1933 | United Kingdom | 428/670 |

*Primary Examiner*—John J. Zimmerman
*Attorney, Agent, or Firm*—Sughrue, Mion, Zinn, Macpeak, and Seas

[57] ABSTRACT

An improved shielding structure for providing shielding from X-ray and gamma radiation, containing at least two, and possibly three layers of material, provided in specific order from the side in which X-ray or gamma radiation is received. The first layer in order has K-edge and $L_I$-edge levels of a first range. The second layer in order has K-edge levels between the K-edge and $L_I$-edge levels, and lower than a secondary radiation level which is emitted by the first layer. A third layer in order has K-edge levels between the K-edge and $L_I$-edge levels of the second layer. Materials such as uranium, lead, and gold, among others, may be used in the first layer. Materials such as tin and indium, among others, may be used in the second layer. Materials such as zinc, copper, nickel, and chromium, among others, may be used in the third layer.

14 Claims, 1 Drawing Sheet

STRUCTURE FOR SHIELDING X-RAY AND GAMMA RADIATION

BACKGROUND OF THE INVENTION

The subject matter of the invention is a structure for shielding X-ray and gamma radiation.

Usually, wall structures made of a metal of high absorption, such as of lead, are used for shielding X-ray or gamma radiation. The thickness of the wall structure is chosen according to the required attenuation of the radiation. The drawback of such known structures is their relatively great weight.

The invention relates to a structure in which various materials are combined in laminated construction.

SUMMARY OF THE INVENTION

Hence, the invention is a structure for shielding X-ray and gamma radiation, which is of laminated construction having at least n layers made of materials different from each other, where n is greater than or equal to two, and each of the first n−1 layers comprises an element converting at least a part of the X-ray or gamma radiation to be shielded or of the secondary radiation emitted by the preceding layer, respectively, into an X-ray or gamma radiation, the energy of which is greater than the energy level defined by the K-edge of the next layer.

According to an embodiment of the invention, the element of the first layer shall be chosen so that its K-edge should be lower than the maximum energy of the X-ray or gamma radiation to be shielded, whereas the element of the second layer —and in the case of n being higher than two each of the further layers—so that its K-edge should be between the K-edge and the L-edge of the element of the preceding layer, advantageously in the vicinity of this L-edge.

The invention can be advantageously made in such a way that the number of the different layers should be two or three. The first layer may comprise uranium, lead, gold, platinum, iridium, osmium, rhenium, tungsten and/or tantalum, whereas the second layer may comprise tin, indidm, cadmium, silver, palladium, rhodium, ruthenium, molybdenum and/or niobium. If there is a third layer, it may comprise zinc, copper, nickel, cobalt, iron, manganese, chromium, vanadium and/or titanium.

As a practical matter, a triple layer combination may be advantageous, where the first layer comprises lead or tungsten, the second layer comprises tin, cadmium or molybdenum, whereas the third layer comprises zinc, copper, nickel, iron or chromium. It is especially favourable if the first layer comprises lead, the second one tin and the third one copper.

A double layer combination may often suffice where the first layer comprises lead, and the second layer comprises tin, cadmium or molybdenum. In the case of a radiation of lower energy, a double layer combination may be adequate, where the first layer comprises tin and the second one copper.

It is highly advantageous if the structure according to the invention is built up of thin layers for increasing the absorption effect. This may occur in such a manner that one or more layers consist of thin layers of identical material between which thin separating layers are arranged. The separating layers may be made of an oxide of the adjacent thin layer or of aluminium, the latter improves the absorption properties of the structure as a layer dispersing the X-ray or gamma radiation. The thin-layer structure according to the invention may also be achieved in such a manner that it comprises a number of layer groups arranged one after the other, each comprising n thin layers of materials different from each other. In this case no thin separating layers are necessary. The aluminium thin layers dispersing the X-ray or gamma radiation, however, are advantageous even here. They may be arranged, e.g. as per layer groups or as per several layer groups.

In the structure according to the invention, built up at least partly of thin layers, the thickness of the thin layers is less than 150 μm, preferably less than 50 μm. In the case of a definite thickness of the whole structure the absorption increases by the reduction of the thickness of the thin layers, i.e. by the increase of the number of thin layers, thus, a thin layer thickness of 0.1–20 μm is especially advantageous. The thin layers arranged in the structure according to the invention need not have by all means the same thickness. The beneficial effect of the thin layers in the structure according to the invention is based presumably on the fact that the barriers at the boundary surfaces of the thin layers are considerably higher than the barriers in the inside of the thin layers, therefore, the thin layers act as boundary surfaces for moving charged particles. Consequently, the thin layers damp the electrons generated both by the Compton-effect and the photoeffect.

In the structure according to the invention the thin layers can be applied to one side of a carrier, advantageously of a copper plate or chromium steel plate protecting against the external effects, arranged on a side of the thin layers which is towards the radiation to be shielded. However, the thin layers may be arranged between two carriers. The thin layers produced, e.g. by rolling can be fastened to each other and to one or two carriers by gluing or pressing. The thin layers may be applied to the carrier by vacuum evaporation, too.

The advantage of the structure according to the invention consists in that a required protection against radiation can be achieved by lower weight and thickness. The structure can be used in each field of the radiation protection. It may be applied e.g. as a casing of an X-ray tube, as a wall or clothing protecting against radiation, and as a radiation shielding of instruments or experimental equipment. It may be produced in rigid or even in flexible form.

BRIEF DESCRIPTION OF THE DRAWINGS

The invention will now be described on the strength of embodiments shown by way of example in the drawings, where.

DETAILED DESCRIPTION OF THE PREFERRED EMBODIMENTS

In the figures identical elements as well as elements of identical function are marked with identical reference numbers.

Figure 1:
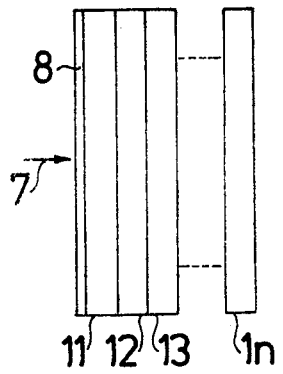
FIG. 1 is a diagrammatic view of a structure according to the invention.

In FIG. 1 a structure shielding the X-ray or gamma radiation arriving from the direction of arrow 7 comprises a protective layer 8 and a number of layers 11, 12, . . . 1n made of materials differing from each other, where n designates the number of the layers.

The material of the first layer 11 from the direction of the arrow 7 shall be chosen according to the maximum energy of the incoming radiation in such a manner that the K-edge of the element of the layer 11 shall be lower than said maximum energy. Table I contains elements from which this element may be chosen in most practical cases. In the following, before the symbol of an element also the atomic number of the element will be given. In Table I there are the K-edge and $L_I$-edge in the radiation absorption of each listed element, as well as the most probable $\alpha 1$ and $\alpha 2$ energy levels of a secondary radiation corresponding to the K-L electron shell transition of the excited element, all these in keV units. From the point of view of the practical application, the most important elements are 92U, 82Pb and 74W. When applying 92U, the radioactive radiation of 92U itself shall also be taken into consideration.

The element of the second layer 12 shall be chosen so that its K-edge shall be in the energy range between the K-edge and $L_I$-edge of the element of the first layer 11, as near as possible to the $L_I$-edge.

Table II contains elements being suitable for the layer 12 if the element of the layer 11 was chosen according to Table I. It can be seen that for the element 92U of the layer 11, in principle, any of the elements 50Sn, . . . 44Ru may be chosen because the K-edge of these latters is higher than the $L_I$-edge of 92U. For any other elements 82Pb, . . . 73Ta of the layer 11, in principle, any of the elements 50Sn, . . . 41Nb may be chosen since even the K-edge of 41Nb is higher than the $L_I$-edge of 82Pb.

TABLE I

| Element | K-edge | $\alpha 1$ | $\alpha 2$ | $L_I$-edge |
|---|---|---|---|---|
| 92 U | 115.6 | 98.4 | 94.6 | 21.7 |
| 82 Pb | 88.0 | 75.0 | 72.8 | 15.9 |
| 79 Au | 80.7 | 68.8 | 67.0 | 14.3 |
| 78 Pt | 78.4 | 66.8 | 65.1 | 13.9 |
| 77 Ir | 76.1 | 64.9 | 63.3 | 13.4 |
| 76 Os | 73.9 | 63.0 | 61.5 | 13.0 |
| 75 Re | 71.7 | 61.1 | 59.7 | 12.5 |
| 74 W | 69.5 | 59.3 | 58.0 | 12.1 |
| 73 Ta | 67.4 | 57.5 | 56.3 | 11.6 |

TABLE II

| Element | K-edge | $\alpha 1$ | $\alpha 2$ | $L_I$-edge |
|---|---|---|---|---|
| 50 Sn | 29.2 | 25.3 | 25.0 | 4.4 |
| 49 In | 27.9 | 24.2 | 24.0 | 4.2 |
| 48 Cd | 26.7 | 23.2 | 23.0 | 4.0 |
| 47 Ag | 25.5 | 22.2 | 22.0 | 3.8 |
| 46 Pd | 24.3 | 21.2 | 21.0 | 3.6 |
| 45 Rh | 23.2 | 20.2 | 20.0 | 3.4 |
| 44 Ru | 22.1 | 19.3 | 19.1 | 3.2 |
| 42 Mo | 20.0 | 17.5 | 17.4 | 2.8 |
| 41 Nb | 19.0 | 16.6 | 16.5 | 2.7 |

The element of the third layer 13 shall be chosen so that its K-edge should be in the energy range between the K-edge and $L_I$-edge of the element of the second layer 12, as near as possible to the $L_I$-edge. Table III indicates elements and their K-edges which are suitable for the purpose of layer 13, if the element of the layer 12 was chosen according to Table II.

TABLE III

| Element | K-edge |
|---|---|
| 30 Zn | 9.7 |
| 29 Cu | 9.0 |
| 28 Ni | 8.3 |
| 27 Co | 7.7 |
| 26 Fe | 7.1 |
| 25 Mn | 6.5 |
| 24 Cr | 6.0 |
| 23 V | 5.4 |
| 22 Ti | 5.0 |

It can be seen that for any one of the elements 50Sn, . . . 41Nb of the layer 12, in principle, any of the elements 30Zn, . . . 22Ti of Table III may be chosen, since even the K-edge of 22Ti is higher than the $L_I$-edge of 50Sn.

In respect of a practical application, the triple layer combination 82Pb - 50Sn or 48Cd - 29Cu or 28Ni and the combination 74W - 50Sn or 42Mo - 30Zn or 24Cr are advantageous. In several cases, the triple layer combination 82Pb - 50Sn - 29Cu is suitable and favourable as for its price.

The structure according to the invention shall not necessarily be provided with a third layer 13 or further layers 13, . . . 1n. A double layer combination 82Pb - 50Sn or 48Cd or 42Mo may also be applied.

For soft radiations /30–88 keV/, a double layer combination shall be applied expediently, where the element of the first layer 11 is 50Sn, that of the second layer 12 is 29Cu.

Figure 2:
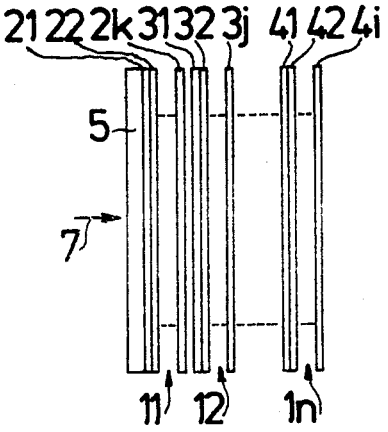
FIGS. 2 and 3 show diagrammatic views of embodiments built up of thin layers according to the invention and FIG. 4 illustrates a diagrammatic view of a further embodiment built up partly of thin layers according to the invention.

FIG. 2 illustrates a structure where all layers 11, 12, . . . 1*n* are built up of thin layers. Accordingly, the layer 11 consists of thin layers 21, 22, . . . 2*k* of identical material, the layer 12 of thin layers 31, 32, . . . 3*j* of identical material, and the layer 1n of thin layers 41, 42, . . . 4*i* of identical material, all arranged on carrier 5. The carrier 5 is on the side of the thin layer package which is towards the radiation and it performs simultaneously the function of a protective layer. Between the thin layers of identical material thin separating layers not shown in FIG. 2 are foreseen, made e.g. of the oxide of the adjacent thin layer or of aluminium. The thin aluminium separating layers disperse the X-ray or gamma radiation and simultaneously increase thereby the shielding effect of the structure. For the sake of demonstration, none of FIGS. 2–4 is proportionate.

Figure 3:
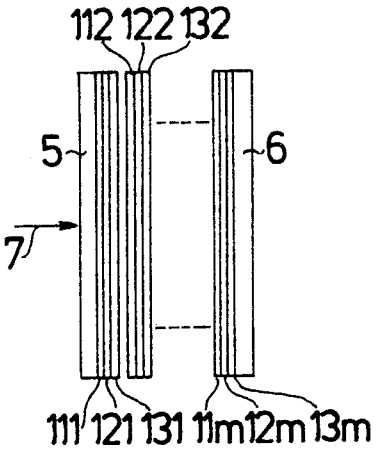

In FIG. 3 the materials of the first thin layer 111, the second thin layer 121 and the third thin layer 131 are chosen according to the structure shown in FIG. 1. Thin layers 111, 121 and 131 form a layer group. In the structure m pieces of such layer groups are arranged one behind the other. The thin layers 111, 121, 131; 112, 122, 132; . . . 11*m*, 12*m*, 13*m* are arranged between two carriers 5 and 6. With this arrangement no separating layer must be placed between the thin layers since the adjacent thin layers are made everywhere of materials different from each other.

Figure 4:
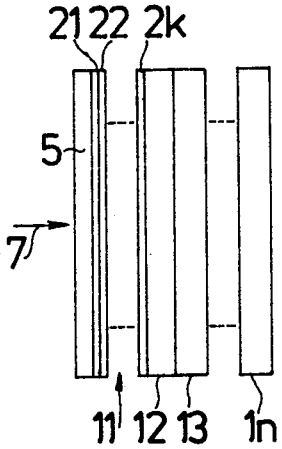

In FIG. 4 such a structure is shown in which only the first layer 11 is built up of thin layers 21, 22, . . . 2*k*, the structure of the other layers 12, 13, . . . 1n is the same as in FIG. 1.

The structure according to the invention may be shaped otherwise than a wall structure shown in the drawings. It may be manufactured e. g. as a flexible plate from which radiation protective clothing may be made or which may be used as a radiation protective casing having no flat surface.

I claim:

1. A structure for shielding X-ray and gamma radiation, said structure having first and second sides, said X-ray and gamma radiation striking said structure on said first side, said structure comprising three layers of materials different from each other, and wherein each of the first two layers, taken in sequence from said first side toward said second side, comprises an element which converts at least a part of the X-ray or gamma radiation to be shielded or of a secondary radiation emitted by a preceding layer closer to said first side, respectively, into secondary X-ray or gamma radiation, and each of the last two layers comprises an element having a K-edge which is in an energy range between first and second energy levels, said first energy level corresponding to an $L_I$-edge of an element in an immediately preceding layer closer to said first side, and said second energy level being higher than said first energy level but lower than an energy level of secondary X-ray or gamma radiation emitted by said immediately preceding layer, wherein said layers comprise, in order from said first side:

a first layer comprising at least one element selected from the group consisting of uranium, lead, osmium, rhenium, tungsten and tantalum, a second layer comprising at least one element selected from the group consisting of tin, indium, palladium, rhodium, ruthenium, molybdenum and niobium, and a third layer comprising at least one element selected from the group consisting of zinc, copper, nickel, cobalt, iron, manganese, chromium, vanadium and titanium.

2. The structure as claimed in claim 1, wherein said layers comprise, in order from said first side, a first layer comprising uranium, a second layer comprising at least one element selected from the group consisting of tin, indium, palladium, rhodium and ruthenium, and a third layer comprising at least one element selected from the group consisting of zinc, copper, nickel, cobalt, iron, manganese, chromium, vanadium and titanium.

3. The structure as claimed in claim 1, wherein said first layer comprises at least one element selected from the group consisting of lead and tungsten, said second layer comprises at least one element selected from the group consisting of tin and molybdenum, and said third layer comprises at least one element selected from the group consisting of zinc, copper, nickel, iron and chromium.

4. The structure as claimed in claim 3, wherein said first one of said layers comprises lead, said second layer comprises tin and said third layer comprises copper.

5. The structure as claimed in claim 1, wherein each of said layers include a plurality of superposed thin layers of identical material and a plurality of thin separating layers disposed between consecutive ones of said superposed thin layers.

6. The structure as claimed in claim 5, wherein said thin separating layers comprise a material selected from the group consisting of aluminum and an oxide of an adjacent one of said superposed thin layers.

7. The structure as claimed in claim 5, wherein the thickness of each of said superposed thin layers is less than 50 μm.

8. The structure as claimed in claim 7, wherein the thickness of each of said superposed thin layers lies in the range between 0.1 and 20 μm.

9. The structure as claimed in claim 5, further comprising a carrier sheet, on said first side of said structure, to which said superposed thin layers and said thin separating layers are applied.

10. The structure as claimed in claim 9, wherein said carrier sheet comprises a material selected from the group consisting of copper and chromium steel.

11. The structure as claimed in claim 9, wherein said superposed thin layers and thin separating layers are applied to said first carrier sheet by vacuum deposition.

12. The structure as claimed in claim 9, further comprising a second carrier sheet on said second side of said structure, wherein said thin layers and said thin separating layers are arranged between said first and second carrier sheets.

13. The structure as claimed in claim 12, wherein said superposed thin layers and said thin separating layers are fastened to each other and to said first and second carrier sheets by gluing or pressing.

14. A structure for shielding X-ray and gamma radiation, said structure having first and second sides, said X-ray and gamma radiation striking said structure on said first side, said structure comprising n layers of materials different from each other, wherein n is an integer greater than or equal to two, and each of the first n-1 layers, taken in sequence from said first side toward said second side, comprises an element which converts at least a part of the X-ray or gamma radiation to be shielded or of a secondary radiation emitted by a preceding layer closer to said first side, respectively, into secondary X-ray or gamma radiation, and each of the last n-1 layers comprises an element having a K-edge which is in an energy range between first and second energy levels, said first energy level corresponding to an $L_I$-edge of an element in an immediately preceding layer closer to said first side, and said second energy level being higher than said first energy level but lower than an energy level of secondary X-ray or gamma radiation emitter by said immediately preceding layer, wherein each of said layers includes a plurality of superposed thin layers of identical material and a plurality of thin separating layers disposed between consecutive ones of said superposed thin layers.

* * * * *